US005466132A

United States Patent [19]

Deal

[11] Patent Number: 5,466,132

[45] Date of Patent: Nov. 14, 1995

[54] PUMP HAVING A ROTARY DISTRIBUTOR

[75] Inventor: Michel Deal, St-Remy-En-Rollat, France

[73] Assignee: Sedepro, Paris, France

[21] Appl. No.: 174,141

[22] Filed: Dec. 28, 1993

[30] Foreign Application Priority Data

Dec. 31, 1992 [FR] France ..... 92 16053

[51] Int. Cl.[6] ..... F04B 7/00

[52] U.S. Cl. ..... 417/519; 137/876; 425/208

[58] Field of Search ..... 417/510, 518, 417/519; 137/876, 565, 624.13, 625.22, 624.14; 264/297.2, 539; 425/208

[56] References Cited

U.S. PATENT DOCUMENTS

| | | | |
|---|---|---|---|
| 952,440 | 3/1910 | Dalzell | 417/519 |
| 1,932,636 | 10/1933 | Gemtman et al. | 417/519 |
| 2,516,388 | 7/1950 | Humphreys | 417/519 |
| 2,696,343 | 12/1954 | Mallory | 417/519 |
| 2,944,288 | 7/1960 | Sherman | 214/37 |
| 3,012,286 | 12/1961 | Gasmire | 264/297.2 |
| 3,090,994 | 5/1963 | Stenger | 264/539 |
| 3,192,914 | 7/1965 | Kopczyk | 417/519 |
| 3,552,440 | 1/1971 | Smith | 417/519 |
| 4,167,374 | 9/1979 | Smith | 417/519 |
| 5,061,158 | 10/1991 | Egli | 417/519 |
| 5,261,795 | 11/1993 | Laurent et al. | 417/205 |

FOREIGN PATENT DOCUMENTS

| | | | |
|---|---|---|---|
| 400496 | 12/1990 | European Pat. Off. . | |
| 545198 | 10/1922 | France . | |
| 58-210381 | 12/1983 | Japan | 417/519 |

*Primary Examiner*—Richard A. Bertsch
*Assistant Examiner*—Peter G. Korytnyk
*Attorney, Agent, or Firm*—Brumbaugh, Graves, Donohue & Raymond

[57] ABSTRACT

A rotary plug 1 has recesses 5 debouching on its side face 12 which are in communication with the inlet 6 and recesses 5 debouching on its side face 13 which are in communication with the outlet 7. These recesses 5 pass across a port 4 which permits passage to and from a unit consisting of cylinder 2 and piston 3.

10 Claims, 3 Drawing Sheets

PUMP HAVING A ROTARY DISTRIBUTOR

BACKGROUND OF THE INVENTION

The present invention relates to piston pumps for very viscous materials. More particularly, it relates to a distributor for such pumps.

In the rubber manufacturing industry, when it is desired to pass unvulcanized rubber continuously through a die in order to obtain a given shape or sheet of rubber, a screw extruder is generally employed. The rotation of the screw makes it possible to transfer the unvulcanized rubber continuously from an inlet trap through which it is generally introduced in the form of a slab or else in the form of a thick strip towards the head of the extruder, where it is compressed under a certain pressure. The rubber then passes through an extrusion orifice of suitable shape.

This technique does not permit complete control of the volumes extruded. For this reason, the prior art also includes a pump for raw rubber described in U.S. Pat. No. 5,261,795. This pump employs a piston which slides within a cylinder. The introduction is effected through ports arranged in the cylinder at a point close to the bottom dead center of the stroke of the piston. The discharge of the rubber from the cylinder is effected through an orifice having a flap valve. The proper operation of such a volumetric pump depends, in particular, on perfect control of the movements of the valve. This leads to preference for a positively actuated valve rather than a simple ball which is held against its seat by a back pressure.

SUMMARY OF THE INVENTION

The object of the present invention is to perfectly control the open state and the closed state of the discharge orifice in a piston pump used with an extremely viscous material such as unvulcanized rubber. It is necessary to assure this perfect closure while assuring sufficient opening of the outlet orifice without opposing the flow of the rubber when the pump is in the delivery phase.

Another object of the present invention is to free an opening having a sufficient cross section of passage in order not to oppose the flow of an extremely viscous material, such as unvulcanized rubber, when the pump is in the admission or outlet stage.

Finally, another object of the present invention is to propose a pump having a minimum number of moving parts, the movements of which are as easy as possible to control.

In accordance with the invention, a rotary distributor is employed which serves to control both the admission into the cylinder and the discharge from the cylinder.

The piston pump of the invention comprises an inlet and an outlet. It has at least one piston sliding in a pumping chamber between a top dead center and a bottom dead center. It has feeding members at the inlet which are arranged in a feed chamber, assuring a forced mechanical transfer of the rubber from an orifice for the introduction of the rubber arranged in the feed chamber towards the said pumping chamber, and it is characterized by the fact that it comprises a rotary distributor inserted between said feed chamber and said pumping chamber, the distributor having piercings so arranged and distributed as at one time to place the chamber in communication with the inlet and at another time to place the chamber in communication with the discharge or to isolate the chamber from any communication with the admission or the discharge, and by the fact that it comprises means for controlling the movement of rotation of the distributor and the synchronized movement of the piston.

In accordance with one embodiment of this pump, the said pumping chamber is a cylinder within which the said piston slides, the cylinder having a port arranged beyond the said top dead center, the port being used both for the admission and for the discharge.

In accordance with another embodiment, said piston is a plunger piston which penetrates into the said pumping chamber.

The preferred application contemplated for such a machine is a pump for raw rubber. However, other applications can be contemplated.

When the piston slides within a cylinder, due to the fact that the only port is located at the top dead center, the cylinder itself has no opening, with the result that the guidance of the piston does not raise any problem. The same port serves for both the admission and the discharge. In this way it may be as large as necessary, up to a cross section comparable to that of the cylinder. This is very favorable for a good flow of the material both towards the inside of the cylinder upon the admission and out of the cylinder upon the discharge. It is no longer necessary to seek a compromise between the admission and the delivery.

In pumping applications it is frequently desired to distribute the pumped material over several different conduits while controlling the flow passing through each of the conduits very precisely. The invention offers the possibility of adapting the distributor so as to distribute the flow at the outlet of the pump over several conduits without it being necessary to use a separate distributor or to multiply the numbers of pumps used.

DESCRIPTION OF THE DRAWINGS

The following figures illustrate the invention and make it possible fully to understand its operation and all of its advantages.

DESCRIPTION OF PREFERRED EMBODIMENTS

Figure 1:
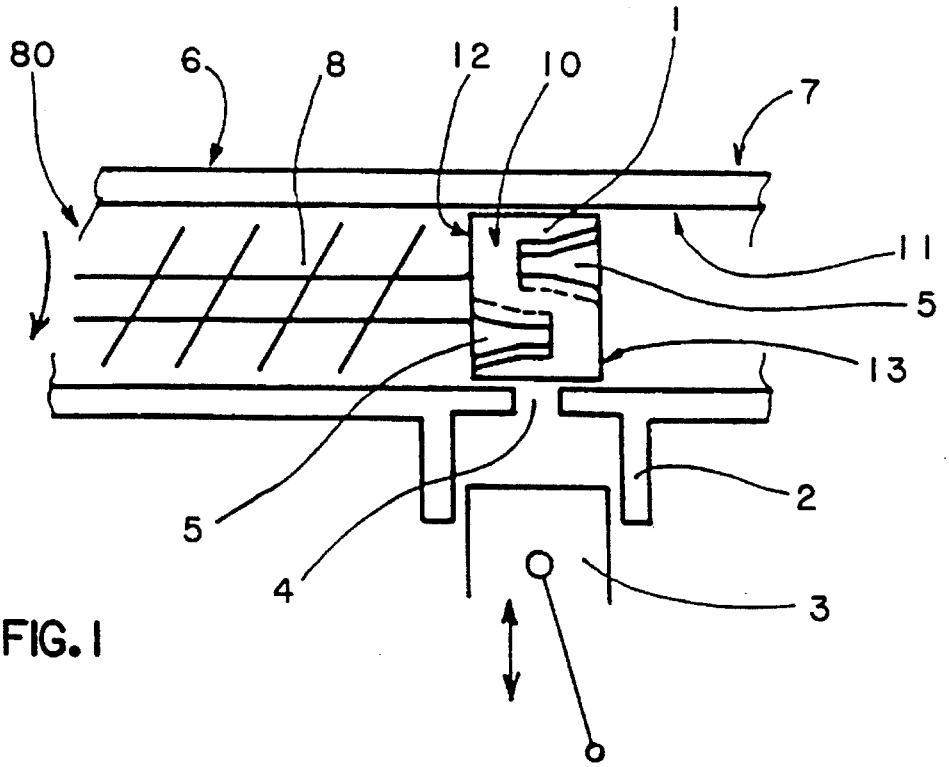
FIG. 1 is a section of a pump embodying the invention.

In FIG. 1 there can be noted a distributor 1 which rotates within a tube between a left-hand end 6 which constitutes the inlet and a right-hand end 7 which constitutes the discharge. The invention is illustrated in its application to volumetric pumps for unvulcanized rubber.

At the inlet, the pump has feeding members arranged in a feed chamber in order to assure a forced mechanical transfer of rubber from an inlet orifice 80 arranged in the feed chamber to the side face 12 of the distributor 1 against which the rubber is applied under pressure. The feeding members consist, for instance, of a screw 8 of the type found in conventional extruders.

A piston 3 can be noted which reciprocates within a cylinder 2. At the upper end of this cylinder 2, top dead center side TDC, a port 4 assures communication between the cylinder 2 and the admission or discharge. The distributor is a plug having a surface of revolution 10 (in this case cylindrical) and two side faces 12 and 13 on opposite sides thereof. The side faces in this case are flat. The plug is mounted for rotation in a sleeve the shape of which corresponds to the shape of the surface of revolution 10. The sleeve in this case is a cylinder 11. The port 4 leads into the inner surface of the sleeve 11. The admission of the pump is in communication with the upstream face 12 and the downstream face 13 is in communication with the discharge of the pump.

The axis of rotation of the distributor is in this case perpendicular to the sliding movement of the piston 3. Piercings are distributed along the entire length of the surface of revolution of the distributor 1. The piercings assume, for example, the shape of recesses 5 notching one of the side faces and the surface of revolution 10. These piercings move over the port 4. They place it in communication alternately with the admission and then with the discharge of the pump. The movements of rotation of the distributor and of translation of the piston must, of course, be synchronized. The step-down ratio present between these two members depends on the number of piercings arranged on the outer cylindrical surface 10 of the distributor 1. If, for instance, the distributor makes a complete revolution for one cycle of the piston, then there is one piercing communicating with the admission and one piercing communicating with the discharge.

Figure 2:
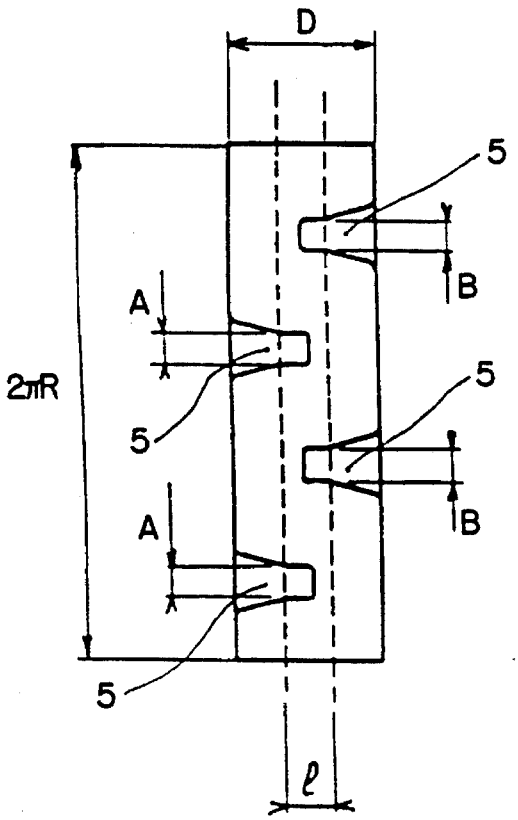
FIG. 2 is a flat developed view of the outer surface of the distributor.
Figure 3:
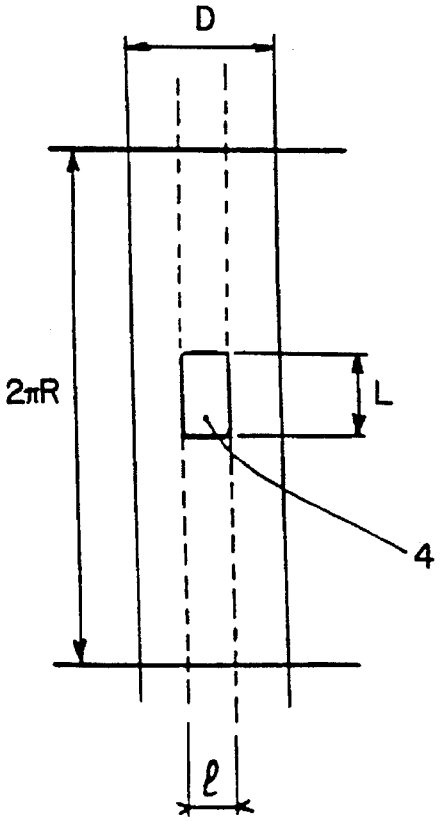
FIG. 3 is a flat developed view of the sleeve around the distributor illustrated in FIG. 2.

FIGS. 2 and 3 make it possible better to understand the operation of the pump, based on a developed view of the surface 10 of the distributor (FIG. 2) and of the corresponding surface of the sleeve (FIG. 3). In this variant, there are two recesses communicating with the admission and two recesses communicating with the discharge.

As the distributor 12 has the shape of a cylinder, the developed view of its outer cylindrical surface is a rectangle shown in FIG. 2. The width D thereof corresponds to the thickness of the distributor 1 in the direction of its axis of rotation. In FIG. 3, the section contained between the two vertical lines separated by the distance D corresponds to the part of the inner surface of the sleeve 11 in contact with the distributor.

The length of the rectangle is equal to $2\pi R$, R being the radius of the distributor 1. The dimensions of the bore formed by the sleeve are, of course, identical, except for functional clearance.

The width 1 of the port 4 is indicated by two parallel dashed lines. The developed view L of the port appears in FIG. 3. In FIG. 2 the section contained between the two vertical lines separated by the distance 1 corresponds to the part of the outer surface of the distributor which passes in front of the port 4.

FIG. 2 shows the surface of the four recesses 5, two of which communicate with the admission on the left-hand side of the figure and two others with the discharge on the right-hand side of the figure.

In operation, there is relative movement between these two surfaces. Let us assume that the surface shown in FIG. 2 slides, for instance from the bottom to the top, in front of the port 4 in such a manner that it passes between the two parallel dashed lines shown in FIG. 2. The admission commences as soon as the port 4 and a recess 5 on the admission side slightly overlap each other.

The recess 5 and the port 4 preferably overlap exactly in the direction of the width of the figures in order to favor the maximum transfer of material. This has not been shown in the diagrammatic FIGS. 2 and 3 in order that the limits of operation of the invention can be clearly understood. The admission continues as long as the port 4 has not completely passed the first recess 5.

Between admission and escape, the surface 10 of the distributor 1 blocks the port 4. In order properly to separate the admission from the discharge, it is therefore sufficient that the distance separating the end of the first recess 5 (corresponding to the admission) from the start of the second recess 5 (corresponding to the discharge) be at least equal to, and preferably very slightly greater than, the length L of the port 4.

If it is assumed that the movement of the piston 3 from its top dead center to its bottom dead center is exactly symmetrical to the movement from the bottom dead center towards the top dead center and that the movement of the distributor 1 is a rotation at constant speed, then the admission takes place during half of the cycle and the discharge takes place during the second half of the cycle. In the case of the developed views in FIGS. 2 and 3, it is therefore necessary to satisfy the relationship $n\ (A+B+2L) \leqq 2\pi R$, in which n is the number of recesses used at the admission (or at the discharge), and therefore in this case n=2.

Furthermore, in order properly to assure the separation of the admission and the discharge, the distance which each time separates the end of the admission recess from the start of the escape recess and vice versa must be equal to at least L.

For a rubber pump having a feed screw 8 at the admission, the simplest embodiment of the invention consists in making the screw and the distributor integral. In FIG. 1 it is seen that the feed screw 8 is in direct engagement on the distributor 1, the axis of rotation of which is identical with that of the screw 8. If there is one revolution of the feed screw 8 for two revolutions of the crank of the piston 3, then two admission recesses 5 and two discharge recesses 5 are provided on the distributor 1.

The shape of the port 4 may be adapted as a function of consideration relative to the flow of the material to be pumped, and/or on basis of considerations relative to the machining of the parts. This shape may approach, or even correspond to, the shape of the cylinder 2. Only the length L of the port in the direction of the development must be selected or adjusted as a function of the length in the direction of the development of the piercings made on the surface of the distributor. Aside from these requirements, the invention offers the possibility of adopting numerous variant shapes.

Figure 4:
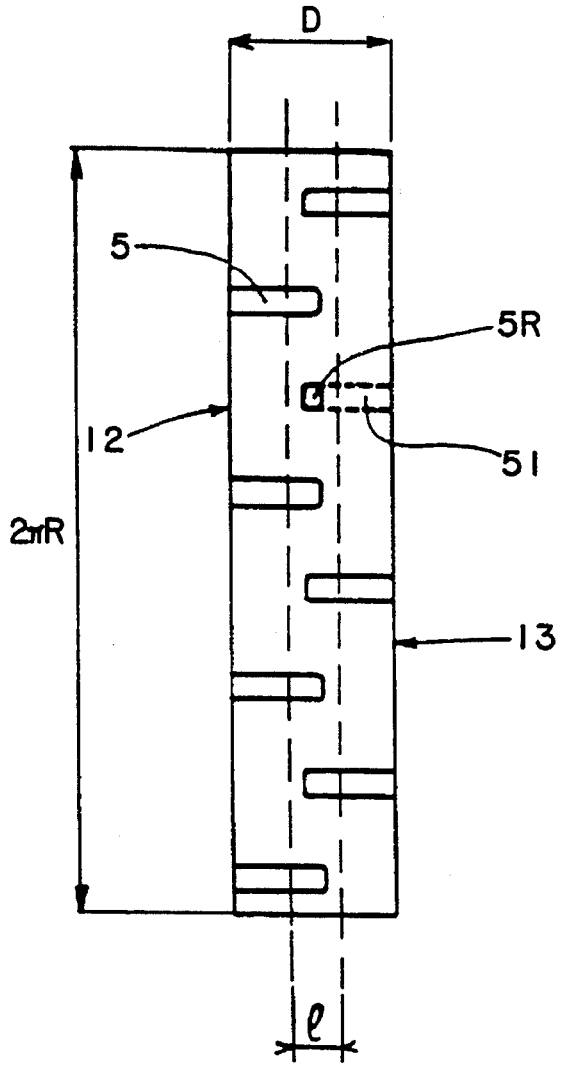
FIG. 4 is a flat developed view of the outer surface of the distributor of another embodiment of the invention.
Figure 5:
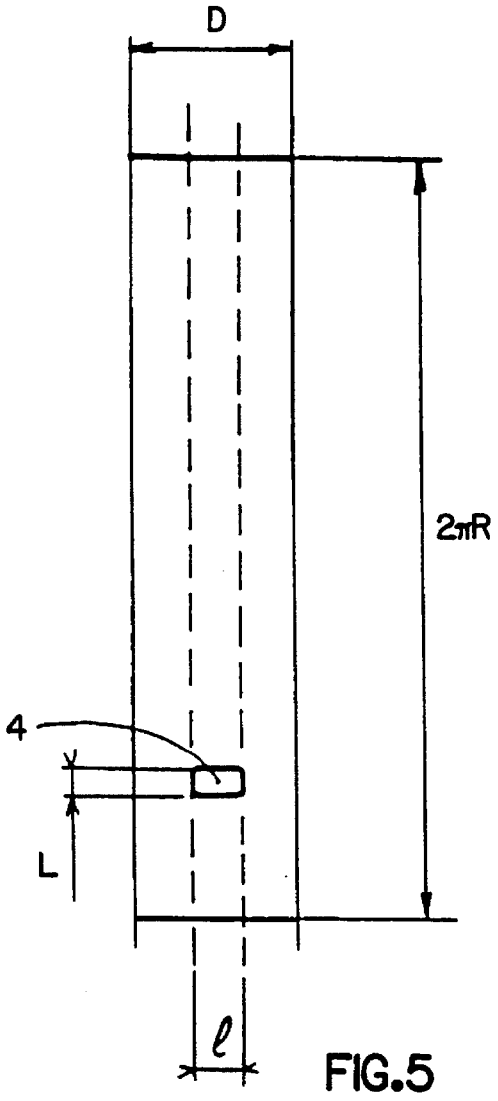
FIG. 5 is a flat developed view of the sleeve around the distributor of FIG. 4.
Figure 6:
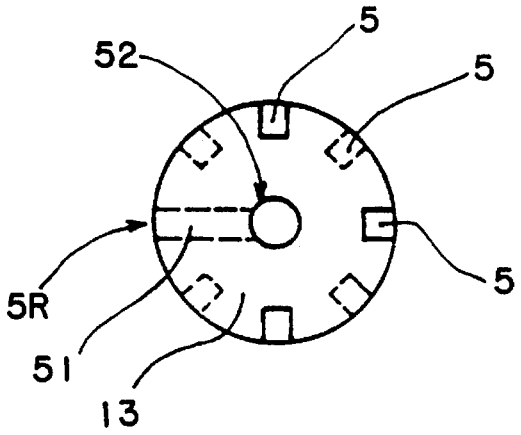
FIG. 6 is side view of the distributor shown in FIGS. 4 and 5.
Figure 7:
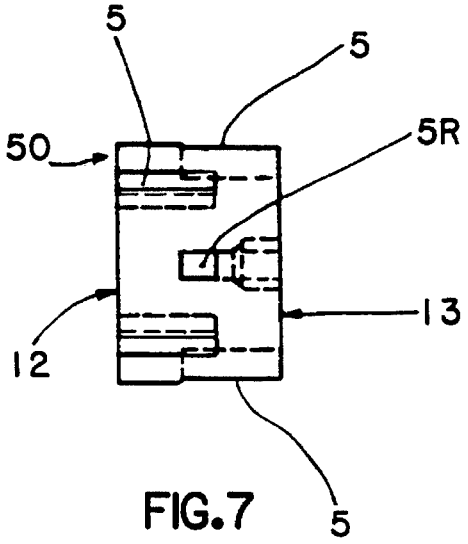
FIG. 7 is a front view of the distributor shown in FIG. 6.

FIGS. 4 and 5 are diagrams providing a developed view of the distributor (FIG. 4) and of the corresponding sleeve (FIG. 5). The distributor has four piercings on the admission and four piercings on the discharge. The admission piercings are all formed by recesses 5 debouching on the side face 12 and on the side face 13 thereof (see FIGS. 6 and 7).

In this embodiment, the distributor makes it possible to distribute the flow delivered by the pump between two different conduits. This is the reason why one of the side faces (in this case, the face 13 corresponding to the discharge, which is the one shown in FIG. 6) has several separate concentric tracks (in this case two), each track being in communication with a different conduit and each track communicating with at least one piercing. One can, of course, provide concentric tracks on the admission side or on the escape side depending on the use desired for the pump.

By "track" there is understood the circular arrangement, that is to say always at the same radial level, of the outlet orifice of all the piercings intended for the collecting (admission) or conducting (discharge) of the material to or towards the same conduit.

On the discharge side, there are provided three piercings in the shape of a recess 5, all similar to the recesses on the admission side, all three leading to the periphery of the face 13, which constitutes a first track permitting the collection of the material in the space which is not movable in rotation. A fourth piercing 5R is extended in a conduit 51, within the distributor, which leads to an orifice 52 constituting a second track, which is concentric with the first. In this case, the material pumped is distributed in a ratio of ¾:¼ between two different delivery conduits: a first annular collector collects the material on the periphery of the side face 13 of the distributor and a second collector, radially to the inside of the first, collects the material delivered by the conduit 51.

Figure 8:
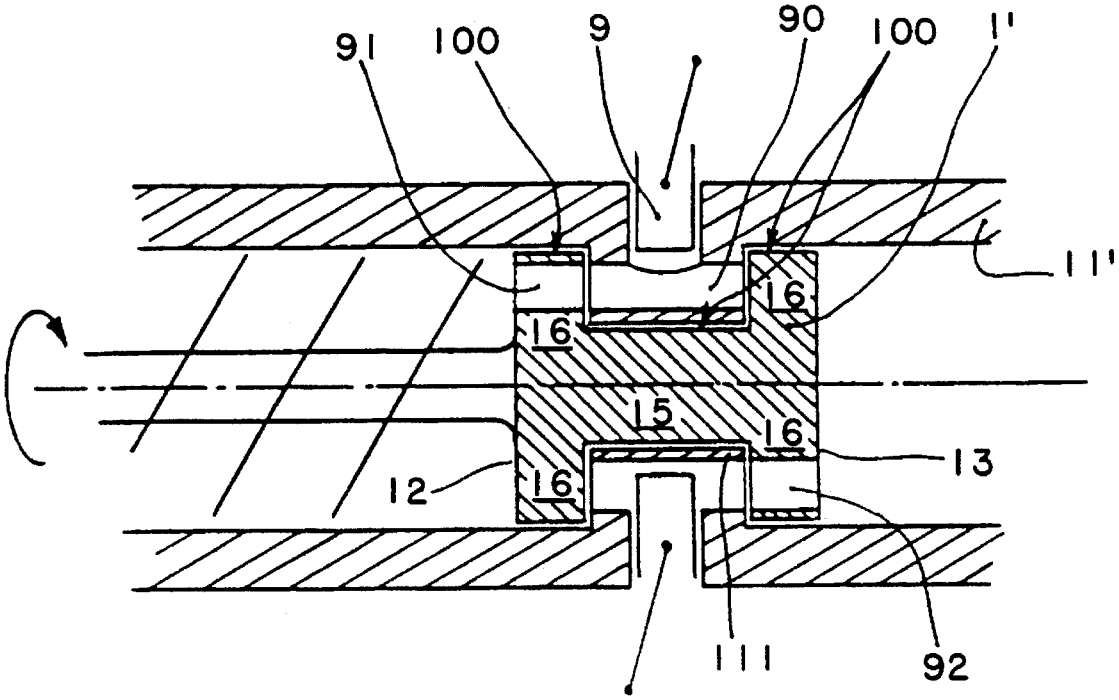
FIG. 8 is a section of another embodiment of the pump of the invention.

In FIG. 8, another embodiment of a pump for raw rubber has been shown in which a plunger piston 9 can penetrate into a pumping chamber 90. The pumping chamber 90 appears twice, associated each time with the piston 9 in a different phase of operation, as will be explained below. Here, again, the distributor is a plug 1' having a surface of revolution 100 and two side faces 12 and 13 on opposite sides thereof. The side faces are flat. The plug 1' is rotatably mounted in a sleeve 11', the shape of which corresponds to the shape of the surface of revolution 100. The pumping chamber 90 debouches on the surface of the sleeve 11'. The admission of the pump leads to the one, face 12 of the side faces, and the discharge leads to the other face 13 of the side faces.

The plug, seen in radial section, has the shape of an "H", the transverse branch 15 of which includes the axis of rotation of the plug, the sleeve forming a protuberance which penetrates between the vertical branches 16 of the "H". The pumping chamber 90 is formed by a channel parallel to the axis of rotation of the plug, developed in the said protuberance 111 on both sides thereof, and the piercings 91, 92 are arranged in the vertical branches of the "H" on opposite sides of the transverse branch 15.

In FIG. 8, it is seen that the two piercings 91 and 92 of the plug 1' are diametrically opposite each other. In the upper part of FIG. 8, the plunger piston 9 has been shown in the position occupied at the end of the admission. The piercing 91 is produced on a circular arc of an angle sufficient to place the admission in communication with the pumping chamber 90 for the entire time during which the plunger piston 9 passes from the top dead center to the bottom dead center. In the lower portion of FIG. 8, the plunger piston 9 has been shown in the position which it would occupy at the end of delivery. The piercing 92 is developed on an arc of an angle sufficient to place the delivery in communication with the pumping chamber 90 for the entire time during which the plunger piston 9 passes from the bottom dead center to the top dead center.

In FIG. 8, in order not to encumber the drawing, it has not been shown that the plug 1 and/or the corresponding sleeve 11' are actually made of several detachable parts so that they can be assembled in the manner shown. These are simple technical details which the person skilled in the art can establish without difficulty.

Figure 9:
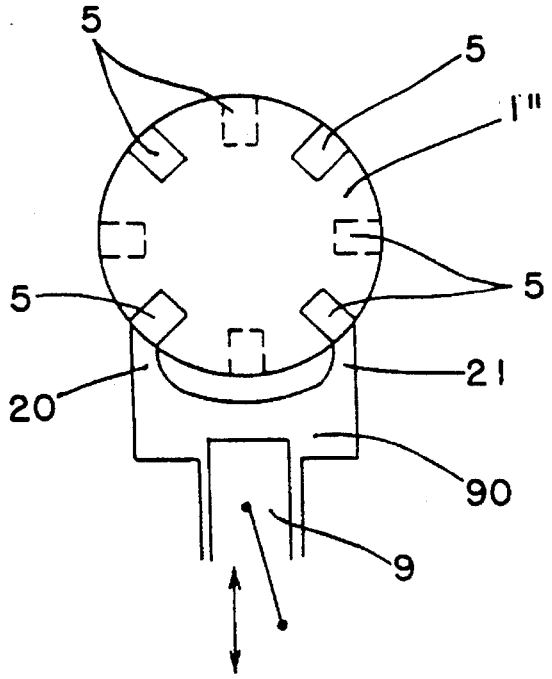
FIG. 9 illustrates still another embodiment of the invention.

Finally, FIG. 9 illustrates an embodiment in which the recesses 5 of a cylindrical plug 1", in this case of a shape similar to that shown in FIGS. 1 to 3, are at all times in communication, several at the same time, with the admission or with the discharge respectively. There can be noted a pumping chamber 90 which debouches on the surface of the sleeve associated with the plug 1" at several places, in this case at two places 20 and 21. A plunger piston 9 assures the admission and the discharge of the material into and out of the pumping chamber 90.

The present invention makes it possible to effect a distribution with a single moving part of very simple movement since it is a movement of rotation. The person skilled in the art can easily contemplate all the possible applications and adapt the embodiment of the invention to the application contemplated.

We may add simply that, if it is desired to avoid any pulsation of the output of a pump, one can, for instance, use two pistons and control their movement by a cam which is properly designed. This makes it possible to impart to each piston an advance at constant speed (for a constant speed of drive of the cam) when it is in delivery phase, to assure the immobility of the pistons when the distributor isolates the pumping chamber from any communication with the discharge, and to assure the complete return of one piston while the other is in delivery phase.

I claim:

1. A pump for viscous material comprising an admission and a discharge, a pumping chamber, at least one piston sliding in the pumping chamber and reciprocating between two extreme positions, feed means arranged in the admission assuring a forced mechanical transfer of the material from the admission towards the said pumping chamber, a rotary distributor between the admission and the said pumping chamber, the distributor having piercings arranged and distributed so as, successively, to place the pumping chamber in communication with the admission and to place the pumping chamber in communication with the discharge, and means for controlling the continuous movement of rotation of the distributor over a complete revolution in synchronism with movement of the piston.

2. A pump according to claim 1, characterized by the fact that the distributor is a plug having a surface of revolution and two side faces on opposite sides thereof, the plug being mounted for rotation in a sleeve of a shape corresponding to the said surface of revolution, and by the fact that the said pumping chamber debouches on the surface of the sleeve and by the fact that the admission extends to one of the side surfaces and the discharge to the other side surface.

3. A pump according to claim 2, characterized by the fact that the said pumping chamber is a cylinder within which the said piston slides, the cylinder having a port arranged beyond one extreme position of the piston, which port is used for both the admission and the discharge of the material.

4. A pump according to claim 2, characterized by the fact that the said piston is a plunger piston penetrating into said pumping chamber.

5. A pump according to claim 2, characterized by the fact that the said plug has, seen in radial section, the shape of an "H" the transverse branch of which includes the axis of rotation of the plug, the sleeve forming a protuberance which penetrates between the vertical branches of the "H", by the fact that the said pumping chamber is formed by a channel parallel to the axis of rotation of the plug and developed in a protuberance on both sides thereof, and by the fact that the said piercings are arranged in the vertical branches on opposite sides of the transverse branch, and by the fact that said piston is a plunger piston penetrating into said channel.

6. A pump according to claim 2, characterized by the fact that the said chamber debouches on the surface of the sleeve at several places.

7. A pump according to claim 2, characterized by the fact that at least some of the piercings are recesses notching one of the side faces and the surface of revolution.

8. A pump according to claim 2, including separate concentric tracks communicating with at least one of the side faces of the plug and separate conduits defined by the piercings for establishing communication between each track and the pumping chamber.

9. A pump according to claim 8, in which there are two concentric tracks on the discharge side of the plug.

10. A pump according to claim 1, characterized by the fact that the feed means include a rotary screw on the distributor, the axis of rotation of said screw and of the distributor being aligned.

* * * * *